US011686008B2

(12) United States Patent
Nien et al.

(10) Patent No.: US 11,686,008 B2
(45) Date of Patent: Jun. 27, 2023

(54) ELECTROPLATING APPARATUS AND ELECTROPLATING METHOD

(71) Applicant: Unimicron Technology Corp., Taoyuan (TW)

(72) Inventors: Heng-Ming Nien, Taoyuan (TW); Chih-Chiang Lu, New Taipei (TW); Cho-Ying Wu, Taoyuan (TW); Shih-Lian Cheng, New Taipei (TW)

(73) Assignee: Unimicron Technology Corp., Taoyuan (TW)

( * ) Notice: Subject to any disclaimer, the term of this patent is extended or adjusted under 35 U.S.C. 154(b) by 0 days.

(21) Appl. No.: 17/745,809

(22) Filed: May 16, 2022

(65) Prior Publication Data

US 2023/0124732 A1 Apr. 20, 2023

Related U.S. Application Data

(60) Provisional application No. 63/255,438, filed on Oct. 14, 2021.

(30) Foreign Application Priority Data

Apr. 6, 2022 (TW) ..... 111113003

(51) Int. Cl.
*C25D 5/00* (2006.01)
*C25D 17/00* (2006.01)

(52) U.S. Cl.
CPC ..... *C25D 5/007* (2020.08); *C25D 17/007* (2013.01)

(58) Field of Classification Search
CPC ..... C25D 7/12–123; C25D 17/001; C25D 17/007; C25D 5/007; H01L 21/2885; H01L 21/76873; H01L 2224/11462
See application file for complete search history.

(56) References Cited

U.S. PATENT DOCUMENTS

2015/0053563 A1* 2/2015 Tsai ..... C25D 7/123 204/279

FOREIGN PATENT DOCUMENTS

| | | |
|---|---|---|
| CN | 1831204 | 9/2006 |
| CN | 1958873 | 5/2007 |
| CN | 110760920 | 2/2020 |
| CN | 112695351 | 4/2021 |

OTHER PUBLICATIONS

Yu, Machine Translation, CN 1831204 A (Year: 2006).*
Mitsui et al., Machine Translation, CN 1958873 A (Year: 2007).*
"Office Action of Taiwan Counterpart Application", dated Mar. 22, 2023, p. 1-p. 5.

* cited by examiner

*Primary Examiner* — Hosung Chung
(74) *Attorney, Agent, or Firm* — JCIPRNET

(57) ABSTRACT

An electroplating apparatus including an anode and a cathode, a power supply, and a regulating plate is provided. The power supply is electrically connected to the anode and the cathode. The regulating plate is arranged between the anode and the cathode. The regulating plate includes an insulating grid plate and a plurality of magnetic components. The plurality of magnetic components are uniformly and randomly arranged on the insulating grid plate. An electroplating method is also provided.

19 Claims, 4 Drawing Sheets

ELECTROPLATING APPARATUS AND ELECTROPLATING METHOD

CROSS-REFERENCE TO RELATED APPLICATION

This application claims the priority benefits of U.S. provisional application Ser. No. 63/255,438, filed on Oct. 14, 2021, and Taiwan application serial no. 111113003, filed on Apr. 6, 2022. The entirety of each of the above-mentioned patent applications is hereby incorporated by reference herein.

BACKGROUND

Technical Field

The disclosure relates to an apparatus and a method, and particularly relates to an electroplating apparatus and an electroplating method.

Description of Related Art

Electroplating has been widely used in various fields. In addition to conventionally serving as a surface treatment method, electroplating is also applied in aspects such as production of circuit boards, semiconductor chips, LED conductive substrates, and semiconductor packages. Meanwhile, electroplating thickness uniformity of a metal plating layer is typically an issue in electroplating.

For example, typically during the production of circuit boards, electric force lines between an anode and a cathode may be affected by properties (e.g., insulation property or other properties that may affect power distribution) of a film layer on the substrate to be plated and change direction when they are close to the substrate to be plated, which causes uneven distribution of density of electric force lines. As such, the metal plating layer formed on the substrate to be plated shows adversely affected electroplating thickness uniformity.

SUMMARY

The disclosure is directed to an electroplating apparatus and an electroplating method, which are adapted to mitigate adversely affected electroplating thickness uniformity of a metal plating layer on a substrate to be plated.

The disclosure provides an electroplating apparatus including an anode and a cathode, a power supply, and a regulating plate. The power supply is electrically connected to the anode and the cathode. The regulating plate is arranged between the anode and the cathode. The regulating plate includes an insulating grid plate and a plurality of magnetic components. The plurality of magnetic components are uniformly and randomly arranged on the insulating grid plate.

In an embodiment of the disclosure, the plurality of magnetic components are uniformly and randomly arranged in a manner generated by a uniform random number generator.

In an embodiment of the disclosure, the plurality of magnetic components are a plurality of permanent magnets.

In an embodiment of the disclosure, a magnetic strength and a placement angle of each of the permanent magnets is generated by the uniform random number generator.

In an embodiment of the disclosure, the plurality of permanent magnets have at least two magnetic strengths.

In an embodiment of the disclosure, the plurality of permanent magnets are arranged on a surface of the insulating grid plate close to the anode.

In an embodiment of the disclosure, the plurality of magnetic components are formed by arranging a set of magnetic materials in a mesh hole of the insulating grid plate.

In an embodiment of the disclosure, arrangement positions of the set of magnetic materials are generated by the uniform random number generator.

In an embodiment of the disclosure, the mesh hole is a hexagonal cellular grid.

In an embodiment of the disclosure, the set of magnetic materials includes a first magnetic material and a second magnetic material, and the first magnetic material and the second magnetic material are respectively arranged on a pair of opposite sidewalls in the hexagonal cellular grid to form a north-seeking pole and a south-seeking pole.

The disclosure provides an electroplating method including at least the following. An electroplating apparatus is provided. The electroplating apparatus includes an anode, a cathode, a power supply, and a regulating plate. The power supply is electrically connected to the anode and the cathode. The regulating plate is arranged between the anode and the cathode. The regulating plate includes an insulating grid plate and a plurality of magnetic components. The plurality of magnetic components are uniformly and randomly arranged on the insulating grid plate. A substrate to be plated is fixed to the cathode. The substrate to be plated includes a dry film. The dry film has at least a first opening and a second opening. The first opening is smaller than the second opening. A plurality of electric force lines moving from the anode toward the cathode are formed after the power supply supplies power. The plurality of electric force lines are passed through the regulating plate and divergently move with a plurality of incident angles, such that the number of electric force lines entering the first opening is less than the number of electric force lines entering the second opening. A metal plating layer is formed on the substrate to be plated.

In an embodiment of the disclosure, divergently moving includes distributing the plurality of electric force lines passed through the regulating plate at different angles relative to the regulating plate.

In an embodiment of the disclosure, divergently moving includes divergently moving by at least two groups of electric force lines.

In an embodiment of the disclosure, the groups of electric force lines are defined by magnetic strengths of the plurality of magnetic components.

In an embodiment of the disclosure, the first opening has a first opening angle, the second opening has a second opening angle, the first opening angle is smaller than the second opening angle, each of the incident angles of the electric force lines entering the first opening is less than or equal to the first opening angle, and each of the incident angles of the electric force lines entering the second opening is less than or equal to the second opening angle.

In an embodiment of the disclosure, the corresponding electric force lines with the incident angles greater than the first opening angle do not enter the first opening, and the corresponding electric force lines with the incident angles greater than the second opening angle do not enter the second opening.

In an embodiment of the disclosure, the plurality of electric force lines linearly move before being passed through the regulating plate.

In an embodiment of the disclosure, the plurality of magnetic components are a plurality of permanent magnets, and the plurality of permanent magnets are adhered to the insulating grid plate.

In an embodiment of the disclosure, the plurality of magnetic components are formed by coating a magnetic material in a mesh hole of the insulating grid plate.

Based on the above description, the electroplating apparatus of the disclosure has the design of the regulating plate between the anode and the cathode, and the plurality of magnetic components of the regulating plate are uniformly and randomly arranged on the insulating grid plate, so that under an effect of a Lorentz force generated between the electric force lines and the regulating plate, multiple electric force lines may divergently move with multiple incident angles after being passed through the regulating plate, so that the number of electric force lines entering the smaller size opening is less than the number of electric force lines entering the larger size opening. Since the number of electric force lines (a concentration of drivable metal ions) may be positively related to a thickness of the formed metal plating layer, the number of electric force lines entering the openings may be effectively screened, such that the part of the substrate to be plated where a circuit is to be formed has a uniform density of electric force lines, which mitigates adversely affected electroplating thickness uniformity of the metal plating layer on the substrate to be plated.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1A:
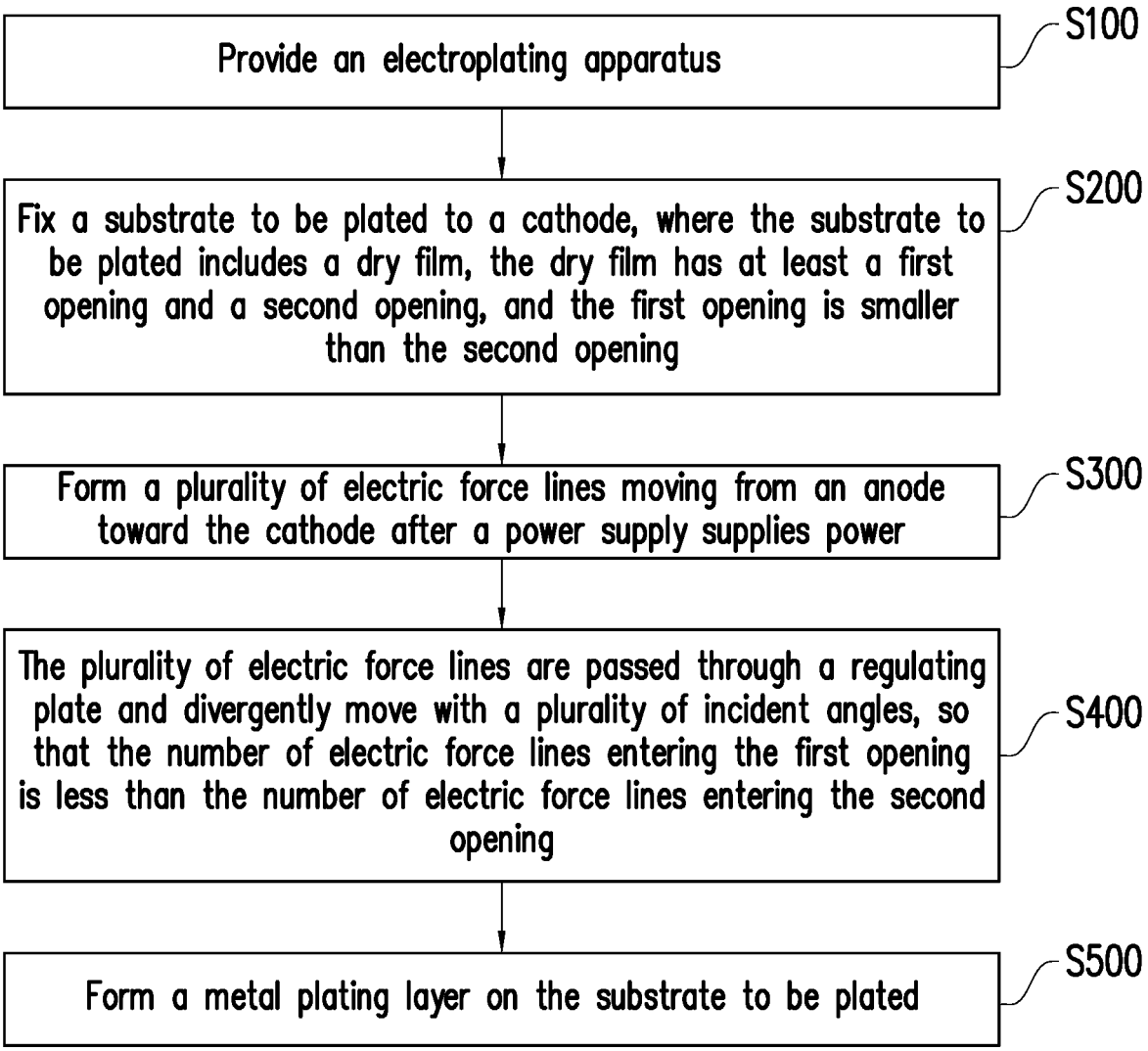
FIG. 1A is a flowchart of an electroplating method according to an embodiment of the disclosure.

Illustrative embodiments of the disclosure will be fully described below with reference to the drawings, but the disclosure may also be embodied in many different forms and should not be construed as being limited to the embodiments described herein. In the drawings, for clarity's sake, the size and thickness of various regions, parts and layers may not be drawn to scale. In order to facilitate understanding, the same elements in the following description will be denoted by the same symbols.

The disclosure is more fully described with reference to the drawings of the embodiment. However, the disclosure may also be embodied in various forms and should not be limited to the embodiments described herein. The thicknesses, sizes or magnitudes of layers or regions in the drawings may be exaggerated for clarity's sake. The same or similar reference numerals denote the same or similar elements, and the repeated descriptions will not be repeated in the following paragraphs.

Directional terms (for example, up, down, right, left, front, back, top, bottom) as used herein are used for reference only to the drawings and are not intended to imply absolute orientations.

It should be noted that although the terms "first", "second", "third", etc. may be used for describing various elements, components, regions, layers and/or portions, but the elements, components, regions, layers and/or portions are not limited by these terms. These terms are only used for separating one element, component, region, layer or portion from another element, component, region, layer or portion.

Unless otherwise defined, all terms (including technical and scientific terms) used herein have the same meaning as commonly understood by one of ordinary skill in the art to which this disclosure belongs.

Figure 1B:
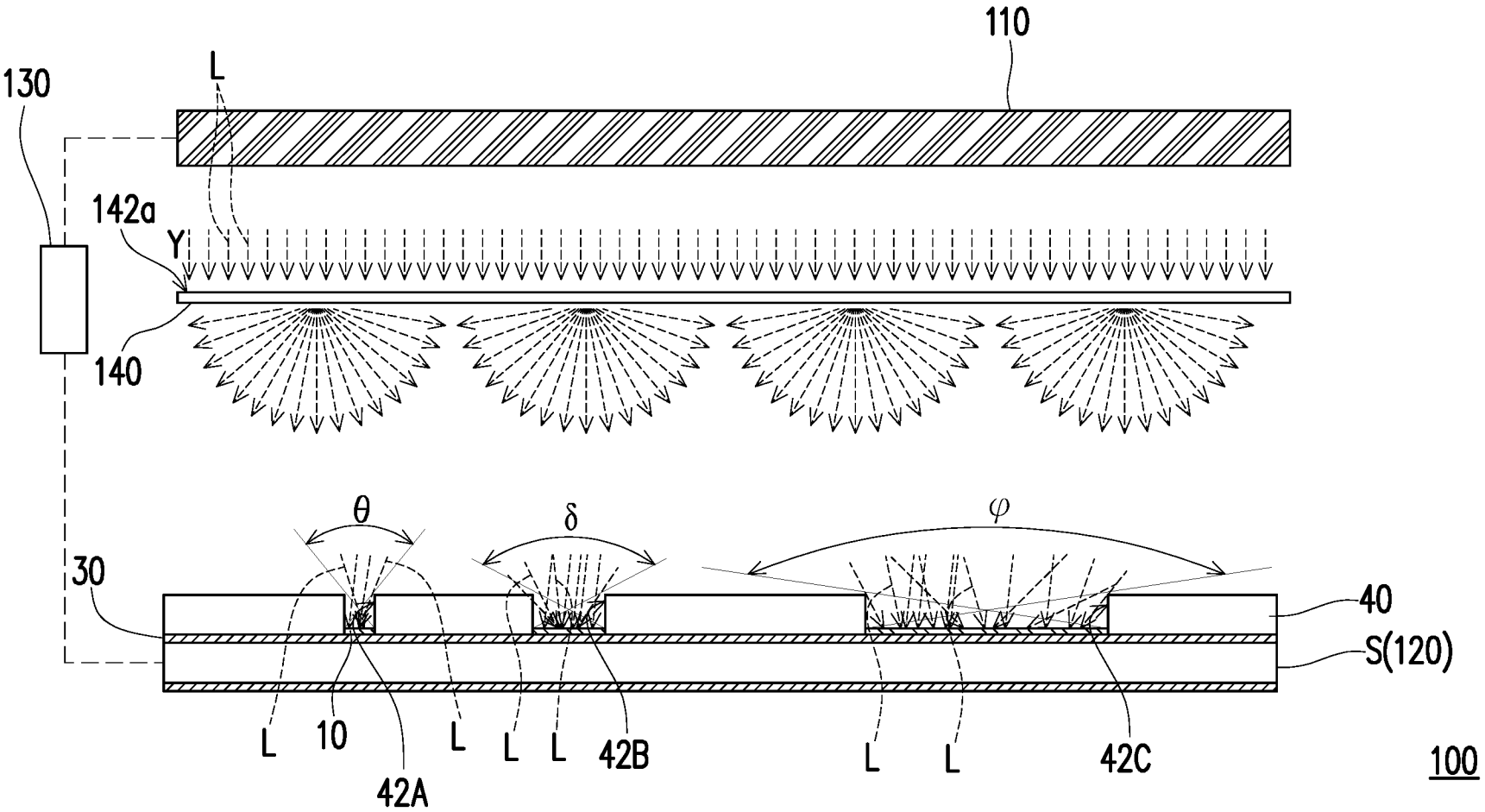
FIG. 1B is a schematic side view of an electroplating apparatus according to an embodiment of the disclosure.
Figure 1C:
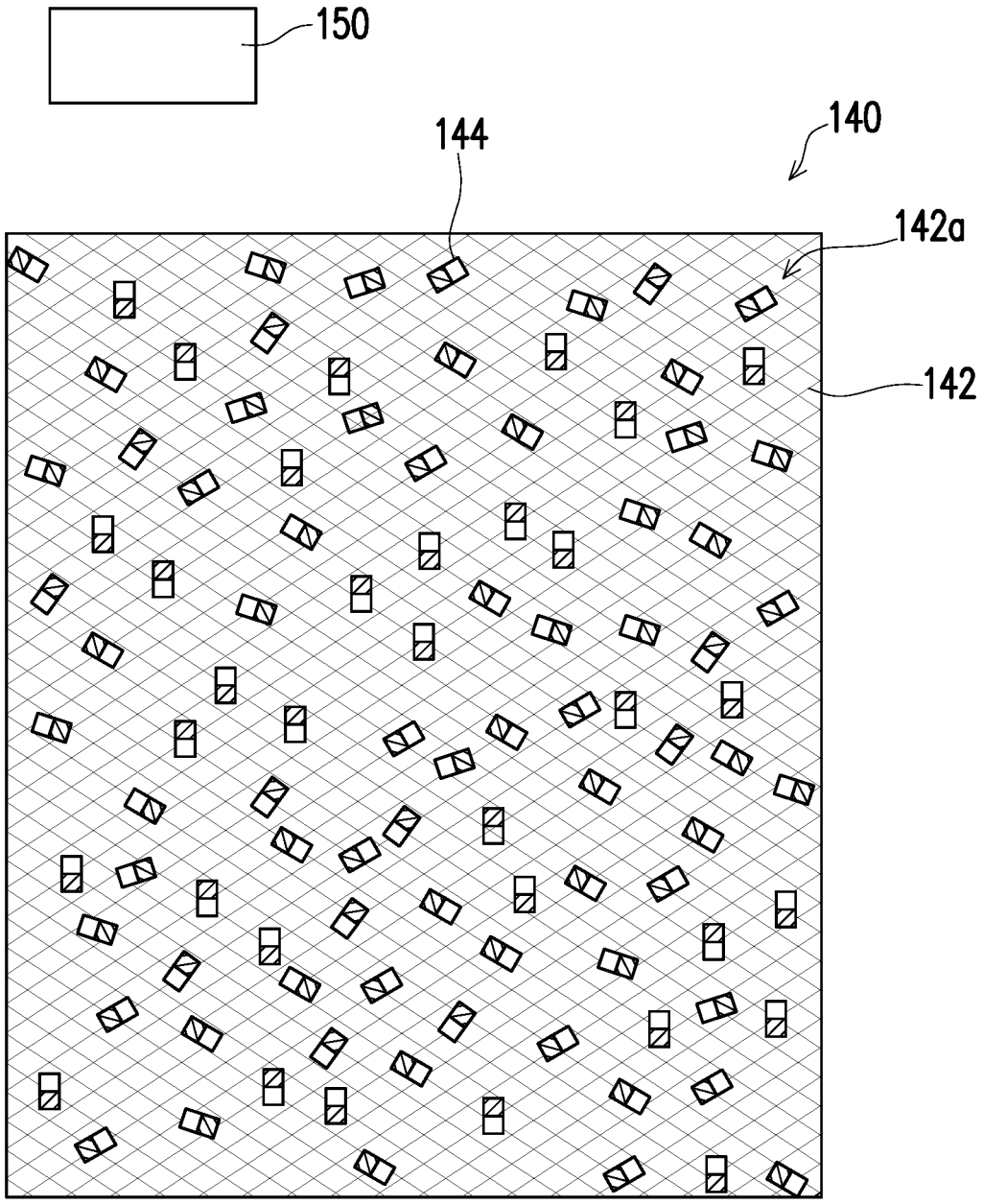
FIG. 1C is a schematic top view of a regulating plate of the electroplating apparatus according to an embodiment of the disclosure.

FIG. 1A is a flowchart of an electroplating method according to an embodiment of the disclosure. FIG. 1B is a schematic side view of an electroplating apparatus according to an embodiment of the disclosure. FIG. 1C is a schematic top view of a regulating plate of the electroplating apparatus according to an embodiment of the disclosure.

Referring to FIG. 1A, FIG. 1B and FIG. 1C, a main flow of the electroplating method of an embodiment of the disclosure is described below with reference of the figures. First, an electroplating apparatus 100 is provided (step S100), where the electroplating apparatus 100 includes an anode 110 and a cathode 120, a power supply 130 and a regulating plate 140. Further, the power supply 130 is electrically connected to the anode 110 and the cathode 120, and the regulating plate 140 is arranged between the anode 110 and the cathode 120 (FIG. 1B schematically shows one regulating plate 140 sandwiched between the cathode 120 and the anode 110), where the regulating plate 140 includes an insulating grid plate 142 and a plurality of magnetic components 144, and the plurality of magnetic components 144 are uniformly and randomly arranged on the insulating grid plate 142.

Moreover, the electroplating apparatus 100 may further include an electroplating tank (not shown) containing an electrolyte (including metal ions Y to be plated), and both of the anode 110 and the cathode 120 are arranged in the electroplating tank. Here, materials and types of the electroplating tank, the electrolyte, the anode 110 and the cathode 120 may be adjusted according to the type of an actual metal to be plated (for example, copper plating), which is not limited by the disclosure. It should be noted that other specific details of the electroplating apparatus 100 will be further described below.

Then, a substrate S to be plated is fixed to the cathode 120, where the substrate S to be plated includes a dry film 40, and the dry film 40 has at least a first opening 42A and a second opening 42B, where the first opening 42A is smaller than the second opening 42B (step S200). A material of the dry film 40 is, for example, an insulating material, and a thickness thereof may be determined according to an actual design requirement. Then, the power supply 130 supplies power to form a plurality of electric force lines L that move from the anode 110 to the cathode 120 (which may be a moving direction of electrons released after the anode 110 is powered on) (step S300). In addition, the plurality of electric force lines L are passed through the regulating plate 140 and divergently move with a plurality of incident angles (as shown in FIG. 1B), so that the number of electric force lines L entering the first opening 42A is less than the number of electric force lines L entering the second opening 42B (step S400). Then, a metal plating layer 10 is formed on the substrate S to be plated (step S500).

In this way, the electroplating apparatus 100 of the embodiment has the design of the regulating plate 140 between the anode 110 and the cathode 120, and the plurality of magnetic components 144 of the regulating plate 140 are uniformly and randomly arranged on the insulating grid plate 142, so that under an effect of a Lorentz force generated between the electric force lines L and the regulating plate 140, the plurality of electric force lines L may divergently move with a plurality of incident angles after being passed through the regulating plate 140, so that the number of electric force lines entering the smaller size opening (for example, the first opening 42A of FIG. 1B) is less than the number of electric force lines entering the larger size opening (for example, the second opening 42B of FIG. 1B), and since the number of electric force lines (a concentration of drivable metal ions Y) may be positively related to a thickness of the formed metal plating layer 10, the number of electric force lines L entering the openings may be effectively screened, such that the part of the substrate S to be plated where a circuit is to be formed has a uniform density of electric force lines, which mitigates adversely affected electroplating thickness uniformity of the metal plating layer on the substrate S to be plated. It should be noted that FIG. 1B is only a schematic illustration that the electric force lines L passed through the regulating plate 140 have the same divergence, which does not represent the actual divergence of the electric force lines L.

The Lorentz force may be represented by $F=q(E+v\times B)$, where F is the Lorentz force, q is a charge amount of charged particles, E is an electric field intensity, v is a speed of the charged particles, and B is a magnetic induction intensity. In addition, in the disclosure, moving directions of the electric force lines may all be regarded as moving directions of the metal ions Y in the electrolyte. On the other hand, a size of the opening may be defined by a line width of the opening. For example, a line width of the first opening 42A may be 20 micrometers, and a line width of the second opening 42B may be 40 micrometers, but the disclosure is not limited thereto.

In some embodiments, the plurality of electric force lines L linearly move before being passed through the regulating plate 140, and the plurality of electric force lines L divergently move after being passed through the regulating plate, since divergently moving may indicate that the plurality of electric force lines L have substantially a same intensity of electric force line L at each angle after being passed through the regulating plate 140, in other words, a concentration of the metal ions Y driven by the electric force line L at each angle is substantially the same, so that the plurality of electric force lines L may be scattered after being passed through the regulating plate 140 and an amount of metal plated per unit area in the opening tends to be balanced. In addition, the plurality of electric force lines L being passed through the regulating plate 140 are distributed at a regular angle relative to the regulating plate 140 (for example, there is one electric force line L every 1 degree), so that the sizes of the first opening 42A and the second opening 42B may be used as a screening condition, and the number of electric force lines L entering the openings may be effectively controlled without additional adding a controller, but the disclosure is not limited thereto.

In some embodiments, divergently moving includes divergently moving by at least two groups of electric force lines (four groups of electric force lines are schematically shown in FIG. 1B), and the groups of electric force lines are defined by magnetic strengths of the plurality of magnetic components 144, but the disclosure is not limited thereto.

In the embodiment, the first opening 42A has a first opening angle θ, the second opening 42B has a second opening angle δ, where the first opening angle θ is smaller than the second opening angle δ, and each of the incident angles of the electric force lines L entering the first opening 42A is less than or equal to the first opening angle θ, and each of the incident angles of the electric force lines L entering the second opening 42B is less than or equal to the second opening angle δ, i.e., the second opening angle δ is larger than the first opening angle θ and thus may receive the electric force lines L with a wider range of incident angles, but the disclosure is not limited thereto.

Further, the corresponding electric force lines L with the incident angles greater than the first opening angle θ do not enter the first opening 42A, and the corresponding electric force lines L with the incident angles greater than the second opening angle δ do not enter the second opening 42B, so that a screening effect may be achieved, but the disclosure is not limited thereto.

In some embodiments, the opening 42 may further include a third opening 42C, the third opening 42C (corresponding to an opening angle φ) is larger than the first opening 42A (corresponding to the opening angle θ) and the second opening 42B (corresponding to the opening angle δ), so that the number of electric force lines L entering the third opening 42C is greater than the number of electric force lines L entering the first opening 42A and the second opening 42B (the opening angle φ is greater than the opening angle δ and the opening angle θ and thus may receive the electric force lines L with a wider range of incidence angles), but the disclosure is not limited thereto. In addition, the corresponding electric force lines L with the incident angles greater than the third opening angle φ do not enter the third opening 42C, so that the screening effect is also achieved, but the disclosure is not limited thereto. A line width of the third opening 42C may be 120 micrometers, but the disclosure is not limited thereto.

In some embodiments, the part of the substrate S to be plated where a circuit is to be formed may include a circuit dense area and a circuit open area (not shown), and adversely affected electroplating thickness uniformity of the metal plating layer in the circuit dense area will be more obvious. Therefore, the electroplating apparatus 100 of the embodiment may more significantly mitigate adversely affected electroplating thickness uniformity of the metal plating layer in the circuit dense area of the substrate S to be plated.

Specific details of the electroplating apparatus 100 are further described below. In the embodiment, the insulating grid plate 142 has a surface 142*a* close to the anode 110, and the plurality of magnetic components 144 are arranged on the surface 142*a*. Further, the plurality of magnetic components 144 may be uniformly and randomly arranged in a manner generated by a uniform random number generator 150 (the uniform random number generator 150 is any suitable tool known to those skilled in the art that may generate uniform random numbers). For example, in the embodiment, the plurality of magnetic components 144 are a plurality of permanent magnets, and the plurality of permanent magnets are arranged on the surface 142*a* of the insulating grid plate 142 (for example, adhered on the insulating grid plate 142), as shown in FIG. 1C, a magnetic strength and a placement angle of each permanent magnet may be generated by the uniform random number generator 150, and the plurality of permanent magnets have at least two magnetic strengths, but the disclosure is not limited thereto, and in other embodiments, the magnetic components may have other different patterns.

It should be noted that FIG. 1C only schematically shows the randomly distributed permanent magnets, and is not intended to limit a configuration pattern of the disclosure, as long as the electric force lines being passed through the regulating plate provided with the uniformly and randomly distributed magnetic components have a plurality of incident angles relative to the substrate to be plated, it is considered to be within a protection scope of the disclosure.

In some embodiments, a distance between the regulating plate 140 and the substrate S to be plated may be between 2 millimeters (mm) and 8 centimeters (cm), but the disclosure is not limited thereto.

In some embodiments, the substrate S to be plated may further include a seed layer 30, so that the metal plating layer 10 may be plated on the seed layer 30, but the disclosure is not limited thereto.

It should be noticed that reference numbers of the components and a part of contents of the aforementioned embodiment are also used in the following embodiment, where the same reference numbers denote the same or like components, and descriptions of the same technical contents are omitted. The aforementioned embodiment may be referred for descriptions of the omitted parts, and detailed descriptions thereof are not repeated in the following embodiment.

Figure 2:
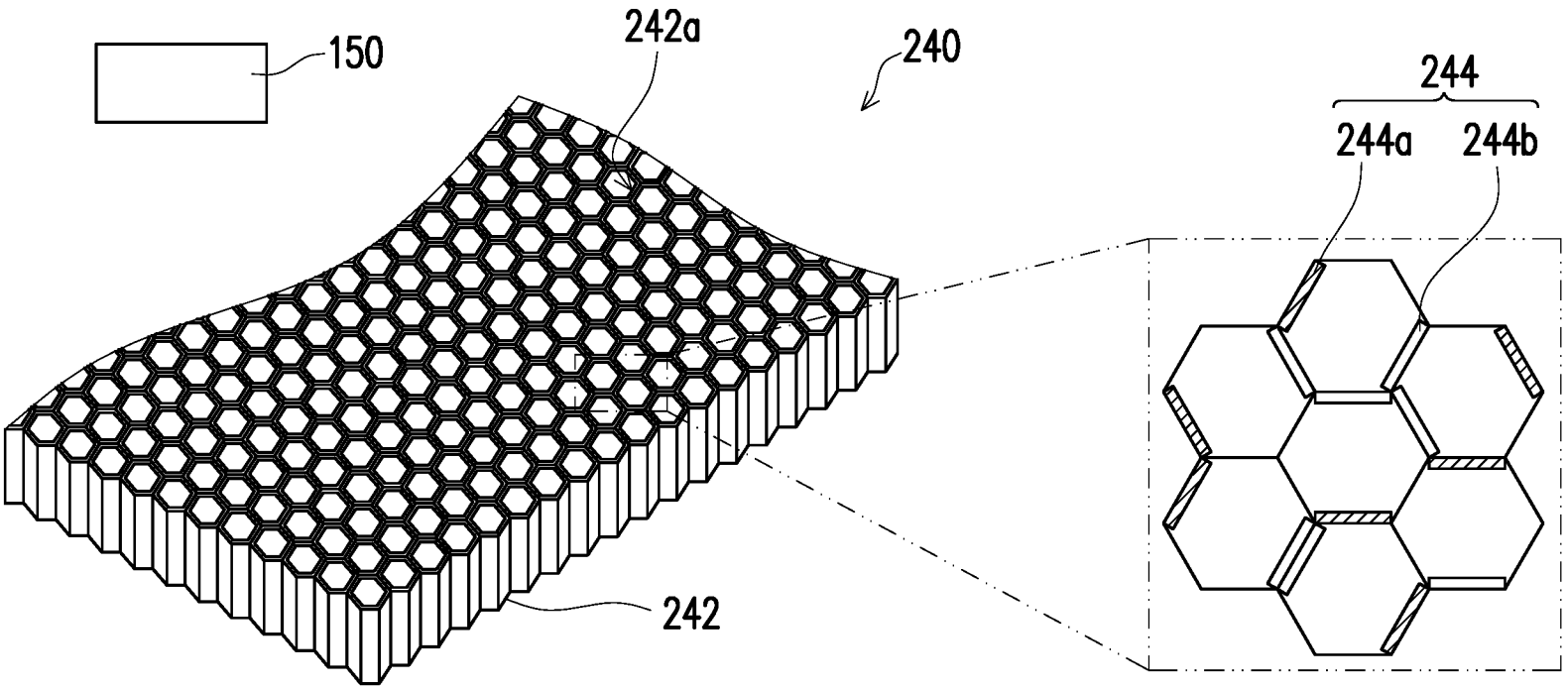
FIG. 2 is a partial schematic three-dimensional view of a regulating plate of an electroplating apparatus according to another embodiment of the disclosure.

FIG. 2 is a partial schematic three-dimensional view of a regulating plate of an electroplating apparatus according to another embodiment of the disclosure.

Referring to FIG. 2, compared with the regulating plate 140 of FIG. 1C, a plurality of magnetic components 244 of a regulating plate 240 of the embodiment are formed by arranging (for example, by coating) a set of magnetic materials in a mesh hole 242*a* of an insulating grid plate 242, where arrangement positions of the plurality of magnetic materials are generated by the uniform random number generator 150.

Further, the one set of magnetic materials may include a first magnetic material 244*a* and a second magnetic material 244*b*, the mesh hole 242*a* may be a hexagonal cellular grid, and the first magnetic material 244*a* and the second magnetic material 244*b* are respectively arranged on a pair of opposite sidewalls in the hexagonal cellular grid to form a north-seeking pole (N pole) and a south-seeking pole (S pole) (to form a magnetic force direction), where the magnetic force direction formed in each mesh hole 242*a* may be different, but the disclosure is not limited thereto.

In summary, the electroplating apparatus of the disclosure has the design of the regulating plate between the anode and the cathode, and the plurality of magnetic components of the regulating plate are uniformly and randomly arranged on the insulating grid plate, so that under an effect of a Lorentz force generated between the electric force lines and the regulating plate, multiple electric force lines may divergently move with multiple incident angles after being passed through the regulating plate, so that the number of electric force lines entering the smaller size opening is less than the number of electric force lines entering the larger size opening, and since the number of electric force lines (a concentration of drivable metal ions) may be positively related to a thickness of the formed metal plating layer, the number of electric force lines entering the openings may be effectively screened, such that the part of the substrate to be plated where a circuit is to be formed has a uniform density of electric force lines, which mitigates adversely affected electroplating thickness uniformity of the metal plating layer on the substrate to be plated.

It will be apparent to those skilled in the art that various modifications and variations can be made to the disclosed embodiments without departing from the scope or spirit of the disclosure. In view of the foregoing, it is intended that the disclosure covers modifications and variations provided they fall within the scope of the following claims and their equivalents.

What is claimed is:

1. An electroplating apparatus, comprising:
an anode and a cathode;
a power supply, electrically connected to the anode and the cathode; and
a regulating plate, arranged between the anode and the cathode, wherein the regulating plate comprises an insulating grid plate and a plurality of magnetic components, and the plurality of magnetic components are uniformly and randomly arranged on the insulating grid plate.

2. The electroplating apparatus according to claim 1, wherein the plurality of magnetic components are uniformly and randomly arranged in a manner generated by a uniform random number generator.

3. The electroplating apparatus according to claim 2, wherein the plurality of magnetic components are a plurality of permanent magnets.

4. The electroplating apparatus according to claim 3, wherein a magnetic strength and a placement angle of each of the permanent magnets is generated by the uniform random number generator.

5. The electroplating apparatus according to claim 3, wherein the plurality of permanent magnets have at least two magnetic strengths.

6. The electroplating apparatus according to claim 3, wherein the plurality of permanent magnets are arranged on a surface of the insulating grid plate close to the anode.

7. The electroplating apparatus according to claim 2, wherein the plurality of magnetic components are formed by arranging a set of magnetic materials in a mesh hole of the insulating grid plate.

8. The electroplating apparatus according to claim 7, wherein arrangement positions of the set of magnetic materials are generated by the uniform random number generator.

9. The electroplating apparatus according to claim 7, wherein the mesh hole is a hexagonal cellular grid.

10. The electroplating apparatus according to claim 9, wherein the set of magnetic materials comprises a first magnetic material and a second magnetic material, and the first magnetic material and the second magnetic material are respectively arranged on a pair of opposite sidewalls in the hexagonal cellular grid to form a north-seeking pole and a south-seeking pole.

11. An electroplating method, comprising:
providing an electroplating apparatus, wherein the electroplating apparatus comprises:
an anode and a cathode,
a power supply, electrically connected to the anode and the cathode; and
a regulating plate, arranged between the anode and the cathode, wherein the regulating plate comprises an insulating grid plate and a plurality of magnetic components, and the plurality of magnetic components are uniformly and randomly arranged on the insulating grid plate;

fixing a substrate to be plated to the cathode, wherein the substrate to be plated comprises a dry film, the dry film has at least a first opening and a second opening, and the first opening is smaller than the second opening;

forming a plurality of electric force lines moving from the anode toward the cathode after the power supply supplies power;

by the plurality of electric force lines, being passed through the regulating plate and divergently moving with a plurality of incident angles, such that the number of electric force lines entering the first opening is less than the number of electric force lines entering the second opening; and forming a metal plating layer on the substrate to be plated.

12. The electroplating method according to claim 11, wherein divergently moving comprises distributing the plurality of electric force lines passed through the regulating plate at different angles relative to the regulating plate.

13. The electroplating method according to claim 11, wherein divergently moving comprises divergently moving by at least two groups of electric force lines.

14. The electroplating method according to claim 13, wherein the groups of electric force lines are defined by magnetic strengths of the plurality of magnetic components.

15. The electroplating method according to claim 11, wherein the first opening has a first opening angle, the second opening has a second opening angle, the first opening angle is smaller than the second opening angle, each of the incident angles of the electric force lines entering the first opening is less than or equal to the first opening angle, and each of the incident angles of the electric force lines entering the second opening is less than or equal to the second opening angle.

16. The electroplating method according to claim 15, wherein the electric force lines with the incident angles greater than the first opening angle do not enter the first opening, and the electric force lines with the incident angles greater than the second opening angle do not enter the second opening.

17. The electroplating method according to claim 11, wherein the plurality of electric force lines linearly move before being passed through the regulating plate.

18. The electroplating method according to claim 11, wherein the plurality of magnetic components are a plurality of permanent magnets, and the plurality of permanent magnets are adhered to the insulating grid plate.

19. The electroplating method according to claim 11, wherein the plurality of magnetic components are formed by coating a magnetic material in a mesh hole of the insulating grid plate.

* * * * *